United States Patent [19]

Zitz et al.

[11] 4,285,549

[45] Aug. 25, 1981

[54] ASSEMBLY FOR COOLING THE TEETH OF THE CUTTING HEAD AND THE ROCK FACE

[75] Inventors: Alfred Zitz; Otto Schetina; Herwig Wrulich, all of Zeltweg, Austria

[73] Assignee: Voest-Alpine Aktiengesellschaft, Vienna, Austria

[21] Appl. No.: 78,835

[22] Filed: Sep. 25, 1979

[30] Foreign Application Priority Data

Oct. 10, 1978 [AT] Austria ..... 7278/78

[51] Int. Cl.[3] ..... E21C 35/22

[52] U.S. Cl. ..... 299/75; 299/12; 299/81

[58] Field of Search ..... 299/1, 17, 81, 64, 75, 299/76, 78, 12

[56] References Cited

U.S. PATENT DOCUMENTS

| | | | |
|---|---|---|---|
| 2,693,950 | 11/1954 | Calder | 299/81 X |
| 2,743,095 | 4/1956 | Wright | 299/81 X |
| 3,980,338 | 9/1976 | Weber | 299/1 |
| 4,186,971 | 2/1980 | Gebetsroither et al. | 299/12 X |

FOREIGN PATENT DOCUMENTS

| | | | |
|---|---|---|---|
| 2032846 | 1/1972 | Fed. Rep. of Germany | 299/81 |

*Primary Examiner*—Ernest R. Purser
*Attorney, Agent, or Firm*—Cushman, Darby & Cushman

[57] ABSTRACT

An assembly for cooling the teeth of the cutting heads of a mining machine and, at the same time, the rock face. The cutting heads are rotatably supported and, at the same time, the rock face, the axis of rotation being essentially horizontal. Cooling is performed by water jets distributed by spray nozzles.

In order to obtain a sufficient cooling effect for the cutting teeth and the rock face with a water consumption as low as possible, there are provided on the jib arm two groups of spray nozzles for each cutting head. The nozzles of the first group are directed to the region of the teeth in the highest position of the same while the nozzles of the second are directed into the interspaces between the rows of teeth in the said region.

The flow of water can be shut off separately for each group of nozzles associated with each of the cutting heads. Since with a mining process in horizontal lines only one cutting head contacts the mining face, in this case flow of water is permitted only to the cutting head which is actually working. Water supply can be shut off separately for each of the two cutting heads.

15 Claims, 9 Drawing Figures

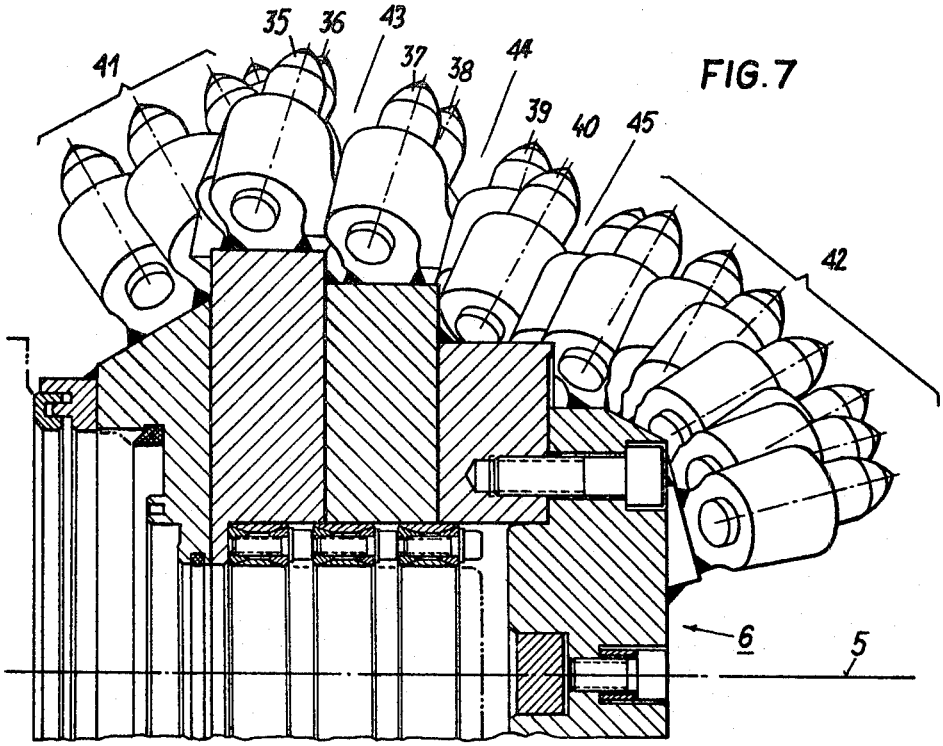
FIG. 7
FIG. 8
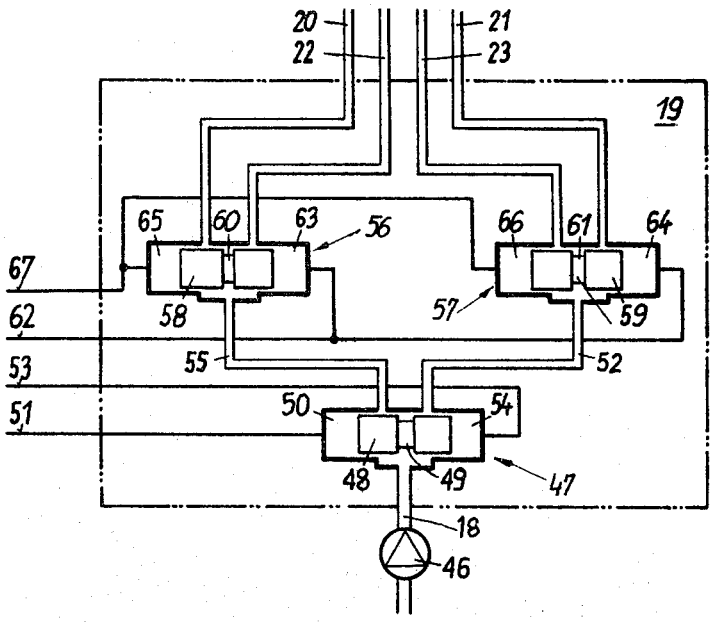

ASSEMBLY FOR COOLING THE TEETH OF THE CUTTING HEAD AND THE ROCK FACE

During mining operation, there may occur high temperatures in the cutting teeth so that cooling the same is advantageous in itself. If the coal layer to be cut contains hard rock inclusions or if a hard dead stratum must be cut, a spark effect may occur and such sparks include explosion danger when gases emerge from the coal layer. To avoid such danger, it has been proposed to supply the cutting teeth with water serving as a cooling medium. In order to prevent the spray nozzles from being contaminated, i.e. clogged, the water must be sprayed out under a high pressure which results in high consumption of water. Neglecting the fact that this greatly influences the water requirements within the mine, the large quantity of water gives rise to many difficulties as the region before the rock face is inundated. Therefore, it has been suggested to locate the nozzles adjacent to each tooth and to restrict the water flow to the rotational angle of the cutting head during which the respective tooth is in cutting position. But this nesessitates a very intricate assembly and, on the other hand, with such an arrangement it is impossible to cope with a high water pressure, and, consequently, it is necessary to spray out the water by pressurized air. This, in turn, results in a rock face not sufficiently cooled, and dust generated by the mining process cannot be trapped sufficiently.

This invention relates to an assembly for cooling the teeth of the cutting head and the rock face, with the cutting heads rotating about an essentially horizontal axis and being supported on a pivotable jib arm, the rotation axis being transverse to the longitudinal extension of the said jib arm, the rotating sense being selected preferably in such a direction that the teeth turned toward the rock move downwards whilst water nozzles are provided and a pair of cutting heads are positioned on either side of the jib arm, the teeth of these cutting heads being distributed in a plurality of circumferential rows axially distant from one another and comprising each one a plurality of teeth.

Object of this invention is to cool sufficiently the cutting teeth near the rock face and to trap in a satisfactory degree the dust generated by the mining process whilst the needed quantities of water should be as low as possible.

The invention consists substantially in that for each of the two cutting heads two groups of spray nozzles are provided on the jib arm, that the nozzles of the first group are directed onto the highest region of the teeth rows extending vertically to the cutting head axis whilst the nozzles of the second group are directed onto the interspace between the teeth rows and at the highest region of the teeth, that the affluence of water can be shut off separately for either of the groups of nozzles associated to one cutting head, and that the flow of water feeding the nozzles of one cutting head can be shut off separately from the flow feeding the other cutting head.

Cutting is performed mostly in substantially horizontal lines, alternating from line to line with the operational direction from right to left and from left to right. The operational advance from one line to the next one occurs either downwards or upwards. Likewise it is possible to work in vertical lines, alternating from upward to downward direction and inversely. In this case advancing is possible to the left or to the right. With the preferred sense of rotation the teeth are working down from above. In this case, the following circumstances are to be considered: When working in horizontal direction and advancing upwards or when working vertically in upward direction, the teeth are operative in the upper fourth part of the cutting head. They enter the rock face approximately in their highest position. The chips generating this way are called "decreasing chips". When working in horizontal lines and advancing downwards or when working vertically in downward direction the teeth begin cutting in the level of the head axis and leave the rock face at their lowest position. The chips are called "increasing chips".

If the teeth are cutting in the upper fourth of the head, working in the "decreasing chip" manner, the nozzle groups directed onto the teeth rows are in operation. At the very moment when the concerned tooth enters the rock face the water jet hits this tooth. As this tooth rotates downwards the water jet hits the grooving cut out by this tooth, until the following tooth reaches its top position and is hit by the water jet. Thus the water flows along the grooving to cool the teeth as well as the rock face.

If the teeth are cutting in the lower fourth part of the head, they work with "increasing chip". In this case the spray nozzles are effective which are directed toward the interspace between the teeth rows. Thus the water jets reach the rock face without being hindered by the rows of teeth. Flowing downwards along the rock face, the water reaches the teeth as they cut in the lower part of the head, i.e. with "increasing chips", to cool the teeth as well as the rock. When cutting is performed in horizontal lines, only one cutting head is actually operating, with exception of the first engageing. Consequently, only one head needs to be cooled so that water affluence to the nozzles associated to the other head may be shut off. If cutting is performed along vertical lines, both cutting heads are working only as long as the first vertical line is worked out. Afterwards, as the cutting heads advance to the left or the right, again only one head is effective. In this case, too, water is cut off with relation to the non-working head. Thus water is fed always exclusively to that region where teeth are cutting whilst the cutting head which is actually out of work receives no cooling water. In this way the present invention enables cooling sufficiently the cutting teeth and the rock face being cut, and likewise the dust originated by the mining process can be trapped, avoiding at the same time loss of water.

The different teeth of a cutting head are subject to strain in a different manner. There are chief cutting teeth and auxiliary cutting teeth. Auxiliary teeth are those teeth which are situated on smaller diameters at the two ends of the cutting head. The chief cutting teeth are positioned substantially around the maximum diameter of the head. According to the invention it is sufficient to direct spray jets only onto the chief teeth and the interspaces therebetween. The auxiliary teeth may be cooled otherwise e.g. manually. There are cutting heads having teeth rows adjacent closely to one another, and other rows distant axially from one another. According to the invention, it is sufficient to provide one nozzle of the first group for every two rows of teeth in common and to provide nozzles of the second group only for the wider interspaces between the more distant rows.

According to the invention the spray nozzles associated to the rows of teeth are preferably directed to the top region of the teeth in the highest position of the same whilst the nozzles associated to the interspaces between the rows are directed to the bottom of the interspace. Thus, it is achieved that the spray jets directed to the rows of teeth aim directly at the groovings cut out by the teeth as the latter move downwards, whilst the jets coming from the second group of nozzles reach as far as possible the rock face.

Preferably, a separate water conduit is provided for each nozzle group. This conduit is connected to all nozzles. It contains a valve means. The said valve means can be controlled in dependence on whether mining is performed with "decreasing chip" or "increasing chip" and in dependence whether the left hand cutting head or the right hand cutting head is actually operating. Likewise it is possible to insert valve means downstream one another within the conduit. In this case, some valve means are to be regulated in dependence of the fact whether mining occurs upon the method of "decreasing chip" or "increasing chip" whilst the other valve means are regulated depending on the fact whether the left or right hand head is operative. With this arrangement water is admitted to any group of nozzles only if both valve means are open.

According to the invention, command of the valve means can be made dependent on the rotating drive mechanism of the jib arm. Preferably the assembly is arranged in such a manner that with a mining machine whose jib arm is rotated hydraulically the valve leading to the first groups of nozzles which are directed onto the rows of teeth are closed when the hydraulic cylinder causing downward motion of the jib arm is pressurized, whilst the valves leading to the second groups whose nozzles are directed to the interspace between the rows are closed when the cylinder causing upward motion is pressurized, and/or that the valves leading to the right-hand cutting head are closed when the cylinder causing left-hand motion is pressurized whilst the valves leading to the left-hand cutting head are closed when the cylinder causing the jib arm to move to the right is pressurized. The hydraulic units causing the jib arm to be moved are loaded by the operative pressure. This pressure indicates which of the cutting heads is working and whether the process of "decreasing chip" or "increasing chip" is adopted.

If a sense of rotation is selected upon which the teeth are working from above downwards, the jib arm is loaded in a downward sense when working occurs with "decreasing chip" and in upward sense when the "increasing chip" procedure is adopted, wherefrom an increase of pressure results in the concerned cylinder. In dependence of this increase of pressure it is possible to regulate automatically the valve means. When penetrating into the rock for the first time all of the teeth at both cutting heads are working. When mining horizontally, in the first time only one cutting head is in operation, no matter whether "decreasing" or "increasing chip" is selected. However, when mining vertically, in the first line both of the heads are working, whether upon "decreasing chip" method or upon "increasing chip" method. In such exceptional case the valve means leading to the different groups of nozzles may be regulated manually.

The valve means leading to the several groups of nozzles can be, e.g. diaphragm valves, the diaphragm of which is exposed to the pressure existing in the concerned cylinder moving the jib arm.

However, in a preferred embodiment of the invention, the valve means consist in axially movable control pistons with cylinder volumes communicating with the working volumes of the hydraulic cylinders operating the jib movement. In this connection it is useful, according to the invention, to arrange the control piston (or pistons) regulating the flow of water to the right hand and left hand cutting head in series with the control piston (or pistons) regulating the flow of water to the first and second group of nozzles. In this way the advantage is achieved that only three control pistons will be sufficient. By means of a spring the said control pistons can be shifted into a position where the flow of water is fully interrupted. During a working interval all of the cylinders moving the jib arm are without pressure, and in this situation the spring becomes effective maintaining the piston in its closing position to interrupt any flow of water. With an adequate arrangement, it is sufficient to equip only one control piston with such a spring.

In a preferred embodiment of the invention the nozzles are positioned on a nozzle supporting member secured on the jib arm and partly overlapping the cutting head. In this way the nozzles come close the rock face whereby the supplied quantities of water are better utilized.

Preferably the nozzles are sized for an exit velocity of about 60 m per s, the feed pressure being about 35 bar.

An embodiment of the invention is shown by way of example on the accompanying drawing.

FIG. 7 is an axial sectional view of a cutting head with its teeth.

FIGS. 8 and 9 show diagrammatically the water distributing plan.

Figure 1:
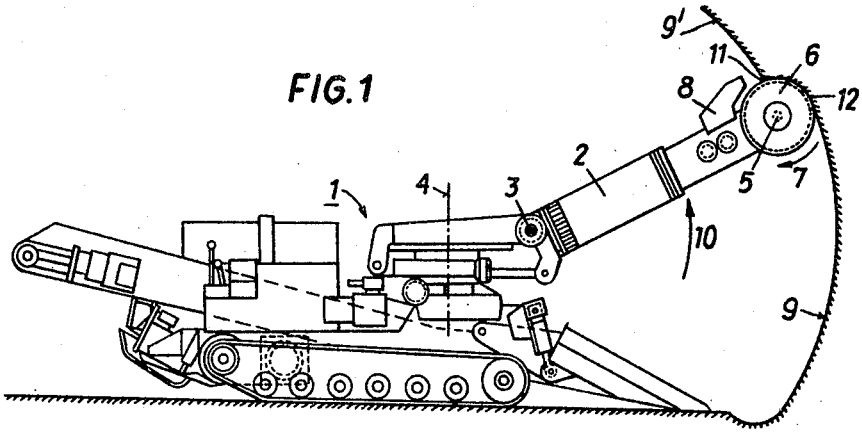
FIGS. 1 and 2 show the mining machine completely with its jib arm and both cutting heads, in side elevation and plan view, respectively.
Figure 2:
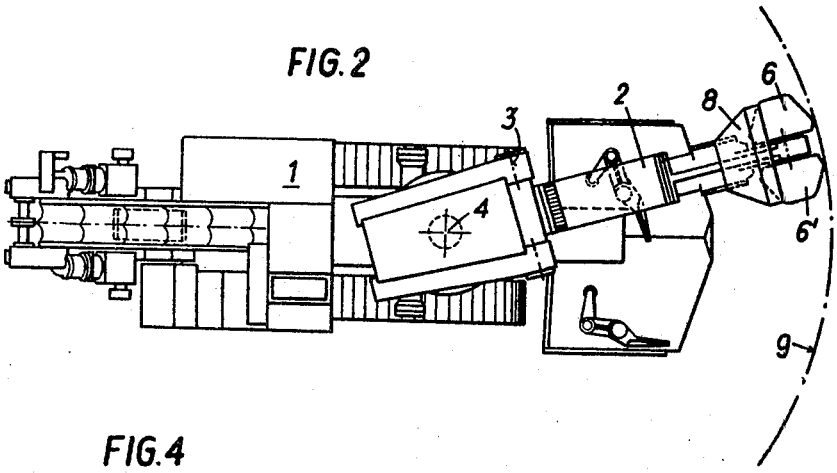

The mining machine 1 as in FIGS. 1 and 2 is equipped with a jib arm 2 pivotable upwards and downwards about a horizontal axis 3 and sidewards about a vertical axis 4. On both sides of the jib arm 2 there are rotatably mounted a pair of cutting heads 6, 6'. The rotating sense is indicated by an arrow 7. A nozzle holder 8 supporting the different groups of nozzles and positioned on the jib arm 2 projects in the plan view partially over the cutting heads. 9 is the coal mine face, 9' is the not yet hewn upper portion thereof.

Cutting is performed in horizontal lines, the jib arm 2 being pivoted about the vertical axis 4. To advance from one horizontal cutting line to the next one, the jib arm 2 is pivoted upwards as shown by the arrow 10. Thus the teeth enter at 11 into the mining face, leaving the same approximately at 12. That means, cutting occurs with "decreasing chip".

Figure 3:
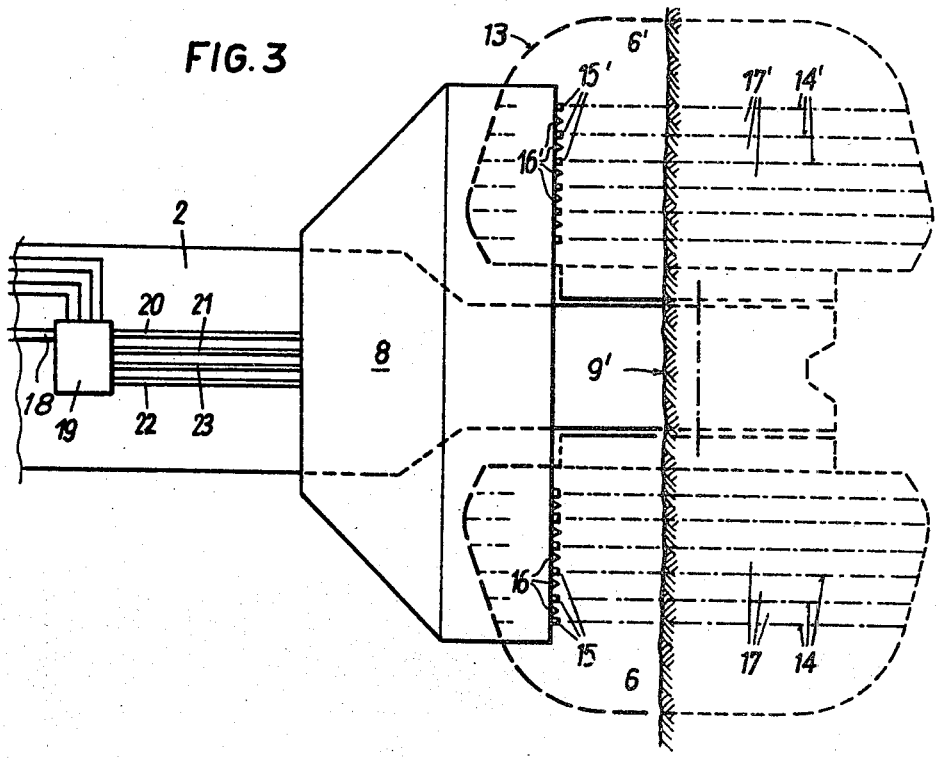
FIG. 3 is a top plan view of a larger scale, showing the cutting heads, working with "decreasing chips".

FIG. 3 shows in plan view the pair of cutting heads, designated 6 and 6', the dotted line 13 being the envelope of the tooth points. The rows of the teeth are represented by dot-and-dash lines 14. On the nozzle supporting means 8 secured to the jib arm 2 there are provided two kinds of nozzle groups. First groups, signed 15 and 15', are directed onto the rows of teeth, 14, the nozzles 15 being associated to the right hand cutting head 6, and the nozzles 15' to the left hand head 6'. Second nozzle groups, 16 and 16', are directed to the interspaces 17, 17' provided between the teeth rows. Again, the nozzles 16 belong to the right hand head 6, the nozzles 16' to the left hand one 6'. There are thus two sets of different nozzles associated with each cutting head. The region of the coal mine face not yet hewn is represented by the wavy line 9'.

Water is fed to the nozzles through a hydraulic main 18 ending in a distributing box 19 wherefrom conduits 20, 21, 22, 23 are preceeding. Conduit 20 feeds the nozzles 15' which are directed to the rows 14' of the left hand cutting head 6'. Conduit 21 feeds the nozzles 16' which are directed to the interspaces 17' of the head 6'. Likewise the conduits 22 and 23 are associated to the nozzles provided at the right hand cutting head. The distributing box 19 contains the valves coordinated to the conduits 20, 21, 22 and 23.

Figure 4:
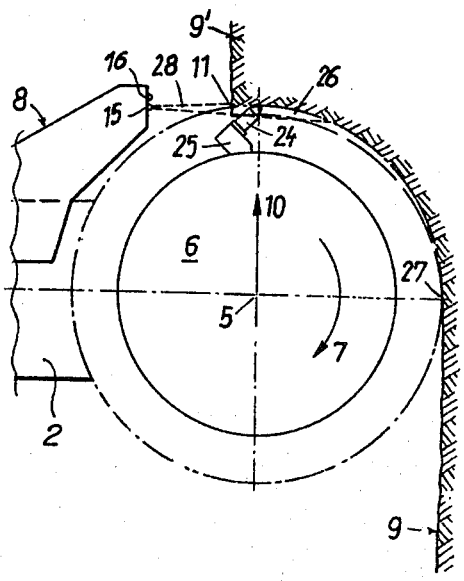
FIGS. 4 and 5 show the cutting head in operative position, cutting "decreasing chips" and "increasing chips", respectively.
Figure 5:
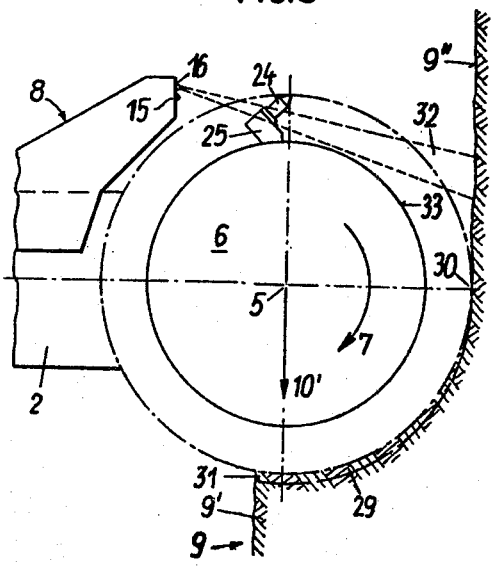

FIGS. 4 and 5 show diagrammatically the right hand cutting head 6 in working position, FIG. 4 representing the "decreasing chip" method and FIG. 5 the "increasing chip" method. In both Figures only one tooth, 24, is shown with its tooth holder 25. An arrow 7 marks the sense of rotation.

The "decreasing chip" of FIG. 4 is signed by 26. 9 is the mining face, 9' the part thereof which is not yet hewn. Therefore, the jib arm 2 is to be lifted upwards, as indicated by the arrow 10. The tooth 24 enters the rock at the point 11. Consequently, the thickness of the chips is greatest at the point 11. Beginning from that point, the thickness decreases till the point 27 approximately in the level of the axis 5 where the tooth 24 leaves the rock face. With this process of working the nozzles 15 are in operation, the water jet 28 being directed immediately onto the point of the tooth 24. As this tooth moves downwardly, the jet aims at the grooving itself just cut out by the tooth 24. The "increasing chip" is shown at 29 in FIG. 5. The portion 9'' of the rock face 9 is already hewn, the portion 9' is still to be hewn. Therefore, the jib arm 2 is to be lowered downwards in the direction indicated by the arrow 10'. The entering point is 30, the leaving point 31 so that the thickness of the chip is increasing. In this case the nozzles 16 must be operated whilst the nozzles 15 are out of action. The spray jet 32 coming from the nozzle 16 should be directed as nearly as possible to the entering point 30, passing through the interspace 17 between the teeth rows 14, aiming at its bottom 33.

Figure 6:
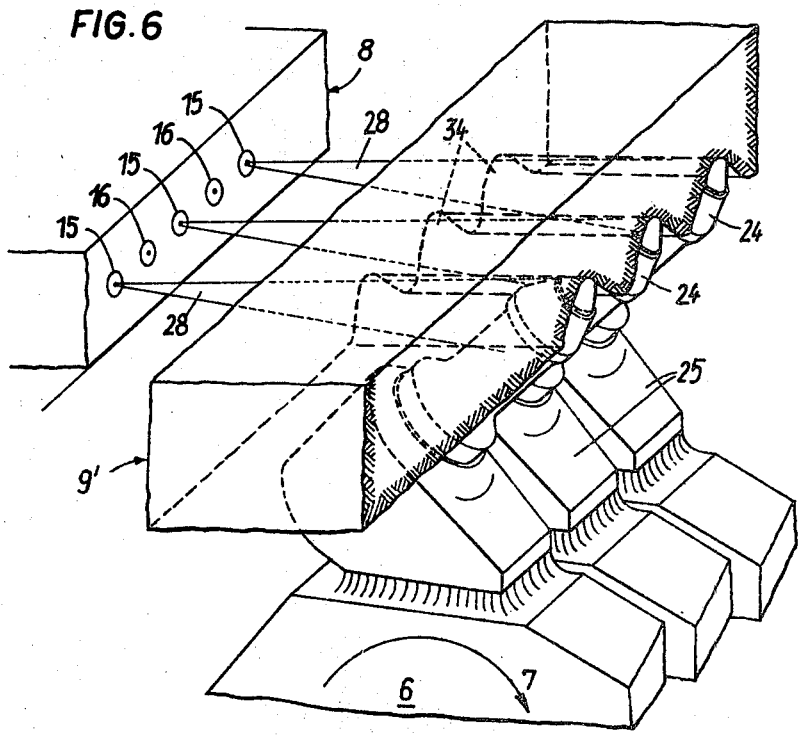
FIG. 6 is a perspective view of the nozzles and the teeth in operative position, working on "decreasing chips".

FIG. 6 shows in perspective view the "decreasing chip" working method. For better clearness, all teeth holder 25 with their teeth 24 are turned to the same angular position. Again, the coal mine face to be worked is signed by 9'. 34 are the groovings cut out by the teeth 24. In this situation the nozzles 15 are operative, the nozzles 16 are out of action. The spray jets 28 are directed onto the teeth 24 and groovings 34.

The axial sectional view of FIG. 7 shows only one half of the cutting head 6. The rows of teeth 35–40 are arranged in planes vertical to the rotational head axis 5. There may be provided four teeth in every row so that their position repeats after every 90° of rotation angle. These six rows 35–40 are the chief cutting teeth. Besides that, two further groups of teeth, 41 and 42, are provided which serve as auxiliary teeth. These two groups of teeth may be cooled manually.

In the example of FIG. 3 the rows of teeth, 35–40, are distributed with substantially equal distances. With such an arrangement, one nozzle of the first group must be provided for each row of teeth and one nozzle of the second group for each interspace. But in the example of FIG. 7 the rows 35 and 36 are positioned adjacent to one another, and likewise the rows 35, 36, the rows 37, 38, and the rows 39, 40 respectively. With this location of the teeth, one jet nozzle is directed to the rows 35 and 36 in common, another nozzle to the rows 37 and 38, and a third nozzle to the rows 39 and 40. The cone of dispersion is wide enough to cover with the same spray jet two rows closely adjacent to one another. In this case, the nozzles of the second group are directed only to the interspaces 43 and 44 which are situated between the rows situated more distantly. In case, spray jets may be directed into the lateral interspaces 45.

FIG. 8 is a diagram of the distributing units contained within the distributing box 19 of FIG. 3. From a high pressure pump 46 water is fed under pressure through a conduit 18. 47 is a valve comprising a two—chamber cylinder containing a control piston 48 having a control notch 49. The left hand chamber 50 of the said cylinder communicates by a conduit 51 with the working chamber of the hydraulic cylinder which is pressurized when the jib arm 2 is to be moved upwards. In this position working occurs with "decreasing chip" and therefore the nozzle group directed onto the rows of teeth must be provided with water. By a pressure within the conduit 51 the control piston 48 is shifted to the right (in FIG. 8), so that the conduit 18 is connected by the notch 49 with a conduit 52.

When the jib arm 2 is pivoted downwards, cutting is performed upon the "increasing chip" method. Then, the nozzles of the second group which are directed to the interspaces must receive water. The right hand chamber 54 communicates through a conduit 53 with the hydraulic cylinder which is pressurized when the jib arm is pivoted in the downward direction. As soon as the said conduit 53 is pressurized, the control piston 48 is shifted to the left and a conduit 55 is connected through the control notch 49 to the pressure conduit 18. Thus, the distribution of water is effective to the nozzles of the first group and to the nozzles of the second group.

There are provided further valves 56 and 57 having control pistons 58 and 59 with control notches 60 and 61, respectively. By means of these pistons the conduits 52 and 55 can be connected to the conduits 20 and 21, respectively, which are associated to the left hand cutting head. If the pistons are shifted to the opposite position, the connection leads to the conduits 22 and 23 associated to the right hand head.

If the jib arm is pivoted to the left, only the left hand cutting head is working. Therefore, the flow of water must be directed to the groups of nozzles belonging to the left hand cutting head. The right hand cylinder chambers 63 and 64 are connected to a conduit 62 which in turn is connected to the hydraulic cylinder moving the jib arm to the left. Therefore, the two control pistons are shifted to the left, connecting the conduits 55 and 20 and, on the other side, the conduits 52 and 21.

When the jib arm is pivoted to the right, only the right hand head is working. The cylinder chambers 65 and 66 of the valves 56 and 57 are connected by means of a conduit 67 to the hydraulic cylinder which is pressurized when the jib arm is pivoted to the right. Consequently, when the right hand head is operating, the pistons 58 and 59 are shifted to the right, connecting the conduits 55 to 22 and 52 to 23.

In this way, the pressure originated within the hydraulic units moving the jib arm causes the pressure conduit 18 to be connected to the corresponding group of nozzles. For this purpose by means of the valve 47 a kind of pre-selection is carried out according to the fact whether the first or the second group of nozzles has to be supplied with water, and then follows the distribution to the right hand or the left hand nozzles.

During a working pause the whole of the hydraulic units operating the jib arm is pressureless. If both chambers 50 and 54 of the valve 47 are without pressure, a spring means (not shown) moves the control piston in a middle position where the control notch 49 communicates neither with the circuit 55 nor with the circuit 52. With this position, water is shut off from all nozzle groups whereby loss of water during working pauses is avoided.

Figure 9:
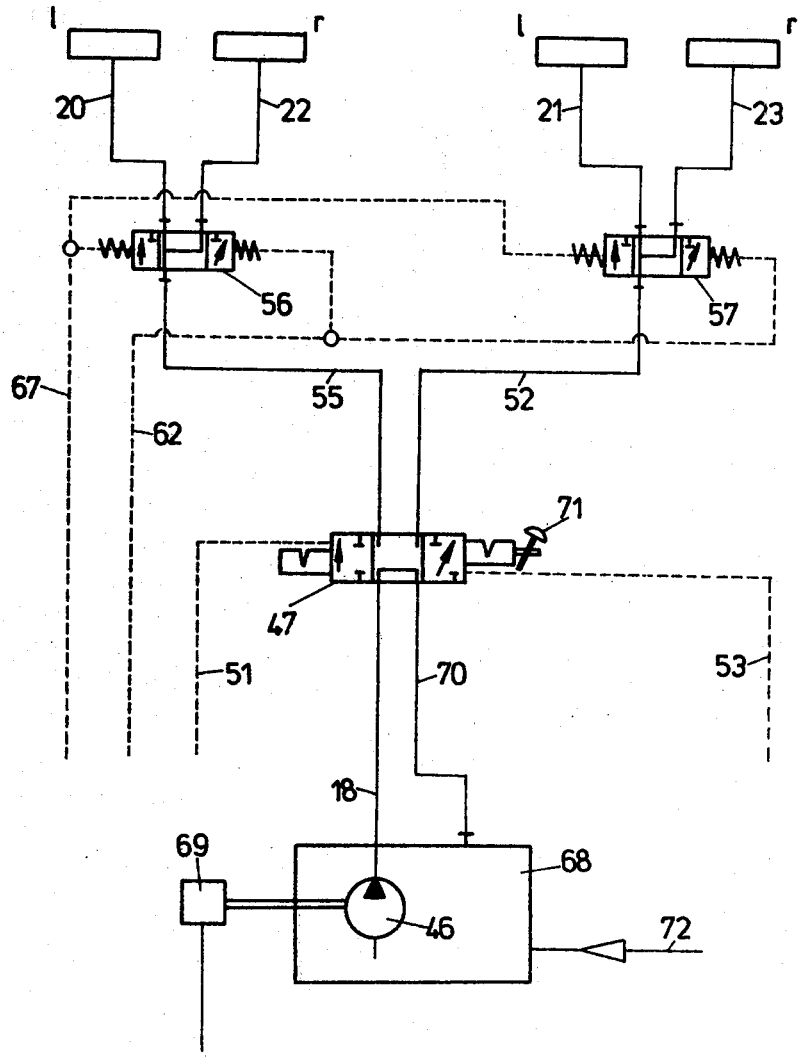

FIG. 9 is a distribution diagram covering every possible operating condition. The reference numbers are the same as in FIG. 8 as far as it is possible. The high pressure pump 46 sucks up the water from a supply vessel 68. It is driven by a motor 69. The water is conveyed through the pressure conduit 18 to the valve 47 which is in its middle position in the drawing of FIG. 9 so that no water is sprayed through the nozzles. The pressurized water flows back through a conduit 70 to the vessel 68 to prevent generating an overpressure in the conduits.

By turning the jib arm to the upward direction the valve 47 is pressurized through conduit 51 and shifted to the right into a first position where it snaps in. Since under the actual condition mining is performed with "decreasing chip", the pressure conduit 18 is put into communication with the conduit 55 which leads to a further valve 56. If merely a movement upwards is accomplished, both the right hand and the left hand group of nozzles must be supplied with water. In this case, the valve piston 56 is in its middle position thereby admitting water to the spray nozzles of both cutting heads. That is to say, conduit 55 is connected to conduit 20 as well as to 22.

If the jib arm out of its upwardly movement is pivoted to the left or to the right, valve 56 shall be shifted to the right or to the left, so that by pivoting the arm to the left the conduit 55 remains in connection only to conduit 20 leading to the left hand nozzles, whilst by pivoting to the right only conduit 22 which belongs to the right hand nozzles receives affluent water. Shifting the piston 56 is caused by pressure in the conduits 62 or 67, respectively. Displacing the piston from its middle position occurs against the force of a spring. When both conduits, 62 and 67, are pressureless, the piston 56 returns to its middle position.

If the jib arm 2 is moved downwards, the piston of the valve 47 is shifted to the left and is catched in this position whereby the pressure conduit 18 is coupled to the conduit 52 which in turn is connected to the conduit 21 and/or 23 leading to the spray nozzles effective with the "increasing chip" method. If the arm is not pivoted sidewards, equal spring forces at both sides of the piston 57 cause the same to remain in its middle position so that again both cutting heads are sprayed at the same time when the arm moves in a purely downward direction. When the arm out of such a movement is pivoted to the left or to the right, the conduit 67 or 62, respectively, will be pressurized shifting the piston 57 out of its middle position. The valve 47, in opposition to the valves 56 and 57, snaps in at its side positions. When the arm is pivoted to the left, pressure in the conduit 67 shifts the valve 57 to the right, interconnecting the conduits 52 and 21. When, on the contrary, the arm moves to the right, the valve 57 moves to the left and conduit 52 is coupled to 23. When conduits 67 as well as 62 are without pressure, spring forces move the piston again in its middle position whereby water is supplied to the conduit 21 and, at the same time, to the conduit 23.

A hand lever 71 provided at the valve 47 permits to move the valve in a desired position independently from the pressure situation in the conduits 51 and 53 which would correspond to a lifting or lowering motion of the jib arm. So it is possible to spray water onto the cutting heads with stationary jib arm which may be useful for cleaning purposes. Inversely, the lever 71 permits to stop spraying while the cutting heads are rotating. In this case, the water returns through the conduit 70 to the vessel 68. The inlet conduit for the vessel 68 is signed 72.

In such cases, particularly if a device is mounted on a mining machine whose center of gravity lies in its rearward region it is useful to select a rotational sense for the cutting heads whereby the teeth are working from below upwards. In this case, the nozzles directed to the interspaces shall receive water. In this way, cooling medium can reach the cutting region to obtain the desired cooling effect.

We claim:

1. An assembly for cooling the teeth of a cutting head and the rock face, with the cutting heads rotating about an essentially horizontal axis and being supported on a pivotable jib arm, the rotation axis being transverse to the longitudinal extension of the said jib arm, the rotating sense being selected preferably in such a direction that the teeth turned toward the rock move from above downwards while a water supply and water nozzles are provided and a pair of cutting heads are positioned on either side of the jib arm, the teeth of these cutting heads being distributed in a plurality of circumferential rows axially distant from one another and each row comprising a plurality of teeth, the said assembly being characterized in that for each of the two cutting heads two groups of spray nozzles are provided on the jib arm, that the nozzles of the first group are directed onto the highest region of the teeth rows extending vertically to the cutting head axis while the nozzles of the second group are directed onto the interspace between the teeth rows and at the highest region of the teeth, that valve means is provided for selectively connecting and disconnecting the water supply for either of the groups of nozzles and for selectively connecting and disconnecting the water supply for all the nozzles associated with each cutting head.

2. The assembly according to claim 1, characterized in that the nozzles are directed only onto the chief teeth or in the interspace therebetween, respectively.

3. The assembly according to claim 1 or 2, with cutting heads having teeth rows adjacent closely to one another, and other rows distant axially from one another characterized in that there is provided one nozzle of the first group for every two rows of teeth in common and that there is provided nozzles of the second group only for the wider interspaces between the more distant rows.

4. The assembly according to claim 1, characterized in that the spray nozzles associated to the rows of teeth are directed to the top region of the teeth in the highest position of the same while the nozzles associated with the interspaces between the rows are directed to the bottom of the interspace.

5. The assembly according to claim 1 wherein the nozzles are positioned on a nozzle supporting member secured on the jib arm and partly overlapping the cutting head.

6. The assembly according to claim 1 wherein said water supply includes a separate water conduit for each nozzle group and wherein said valve means includes a valve associated with each of said water conduits.

7. The assembly according to claim 6 wherein said valve means is responsive to a rotating drive mechanism of the jib arm.

8. The assembly according to claim 6 wherein said jib arm is rotated by a hydraulic cylinder and wherein the valve leading to the first group of nozzles is closed when the hydraulic cylinder causing downward motion of the jib arm is pressurized, while the valve leading to the second group of nozzles is closed when a cylinder causing upward motion is pressurized.

9. The assembly according to claim 8 characterized in that said valves comprise axially movable control pistons with cylinder volumes communicating with the working volumes of the hydraulic cylinders operating the jib movement.

10. The assembly according to claim 9 wherein said valve means also includes another valve which controls water flow from the water supply to said separate water conduits and wherein the control pistons of the valves associated with said separate water conduits for regulating the flow of water to the two cutting heads are arranged in series with the control piston of said other valve.

11. The assembly according to claim 10, characterized in that by means of a spring said control piston of said other valve is shifted into a position where the flow of water is fully interrupted.

12. The assembly according to claim 1 characterized in that the nozzles are sized for an exit velocity of about 60 m per s, the feed pressure being about 35 bar.

13. In a mining machine having a jib arm which carries a pair of rotary cutting heads positioned on opposite sides of the jib arm, each cutting head having a plurality of axially spaced-apart circumferential rows of cutting teeth: an assembly for cooling the cutting teeth comprising first and second sets of nozzles associated with each cutting head, the first set being disposed to direct cooling fluid on to the teeth of the respective cutting head and the second set being disposed to direct cooling fluid into the space between the rows of teeth of the respective cutting head, said first sets forming one group of nozzles and said second sets forming another group of nozzles; a water supply main; and valve means for selectively and independently controlling the flow of cooling fluid to each group of nozzles and for selectively and independently controlling the flow of cooling fluid to all the nozzles of each respective cutting head.

14. A mining machine as in claim 13 including two water conduits and wherein said valve means includes a first valve having a first outlet connecting with one of said water conduits and a second outlet connecting with the other water conduit; a second valve in one of said water conduits having two outlets each connecting separately with one of said first nozzle sets, a third valve in the other water conduit have two outlets each connecting separately with one of said second nozzle sets.

15. A mining machine as in claim 14 wherein said first valve can block flow to both of said water conduits and wherein said second and third valves can supply flow to both of their outlets simultaneously.

* * * * *